United States Patent [19]

Ness et al.

[11] 3,933,164

[45] Jan. 20, 1976

[54] PORTABLE DUCK BLIND CAMP COT AND BACK PACK

[76] Inventors: Philip J. Ness, 5948 Mendocino Blvd., Sacramento, Calif. 95824; Barney S. Kawada, 5930 24th St. 58, Sacramento, Calif. 95822

[22] Filed: Jan. 29, 1974

[21] Appl. No.: 437,641

[52] U.S. Cl. ..... 135/1 R; 135/3 R; 135/15 CF; 135/DIG. 1; 135/DIG. 6; 224/9; 5/114

[51] Int. Cl.[2] ..... A45F 1/00

[58] Field of Search ..... 224/8 R, 25 A, 9, 10; 5/113, 114, 157, 184; 135/3 R, 4 R, 15 CF, 5.2, DIG. 1, DIG. 6, 1 A, 1 R; 296/105; 43/1; 285/302, 303

[56] References Cited

UNITED STATES PATENTS

| | | | |
|---|---|---|---|
| 46,195 | 1/1865 | Weber | 224/9 |
| 1,080,577 | 12/1913 | Pascale et al. | 5/184 |
| 1,305,388 | 6/1919 | Luria | 5/184 |
| 1,586,355 | 5/1926 | DeFranco | 5/184 |
| 2,546,452 | 3/1951 | Kmieliauskas | 285/302 |
| 3,223,300 | 12/1965 | Moore et al. | 224/25 A |
| 3,347,575 | 10/1967 | Morris | 285/303 |
| 3,828,992 | 8/1974 | Cerchione | 224/9 |

*Primary Examiner*—Robert J. Spar
*Assistant Examiner*—Lawrence J. Oresky
*Attorney, Agent, or Firm*—Blair & Brown

[57] ABSTRACT

A portable duck blind camp cot and back pack consists of a plurality of telescoping frame sections each having support legs to support the cot or duck blind from the ground. With the frame sections telescoped together a pair of shoulder straps on an end section permit the device to be used as a back pack. A folding cover also formed of telescopic sections is adapted to overlay the cot to form a duck blind to completely hide the hunter and yet be quickly and easily removed when the hunter raises himself to a shooting position.

1 Claim, 10 Drawing Figures

FIG. 1.
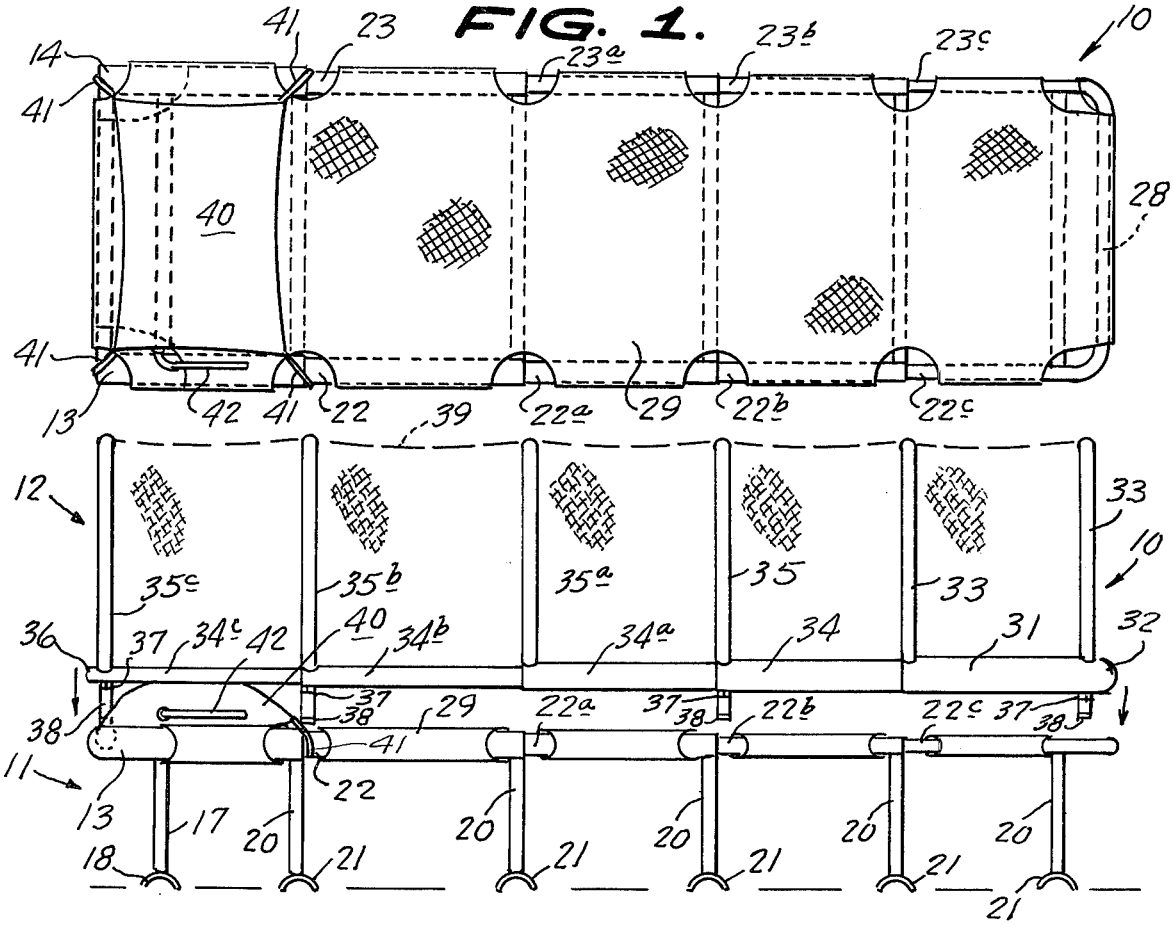
FIG. 2.
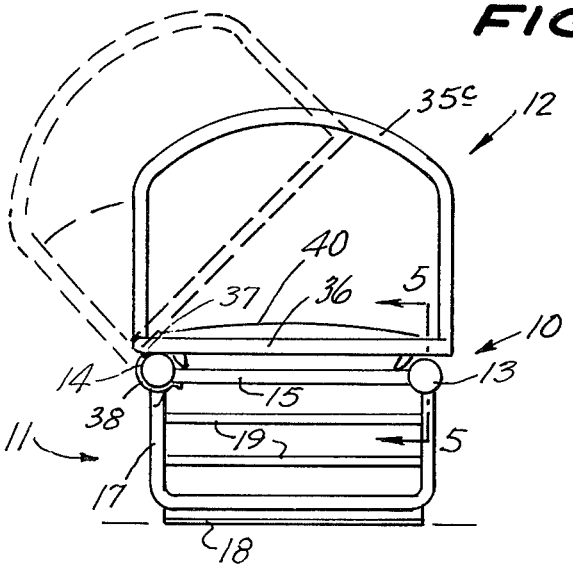
FIG. 3.
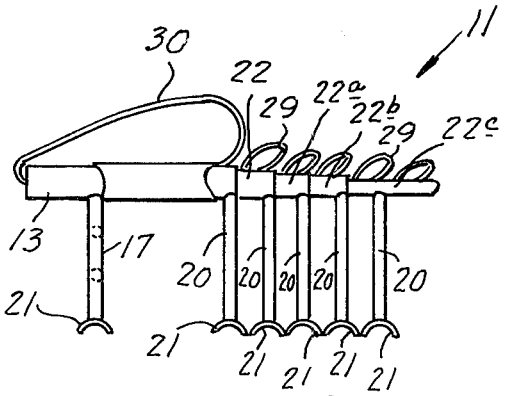
FIG. 4.

FIG. 5.
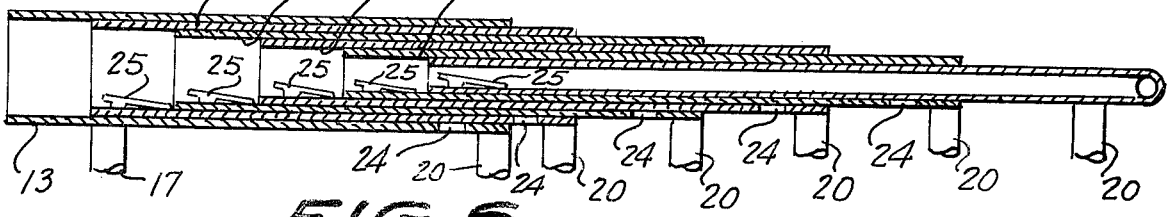
FIG. 6.
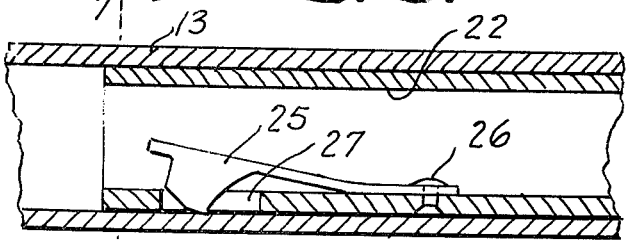
FIG. 7.
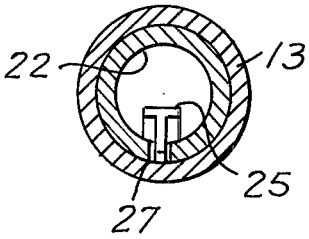
FIG. 8.
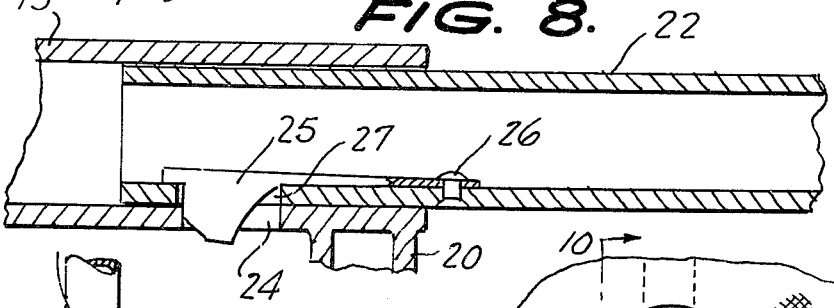
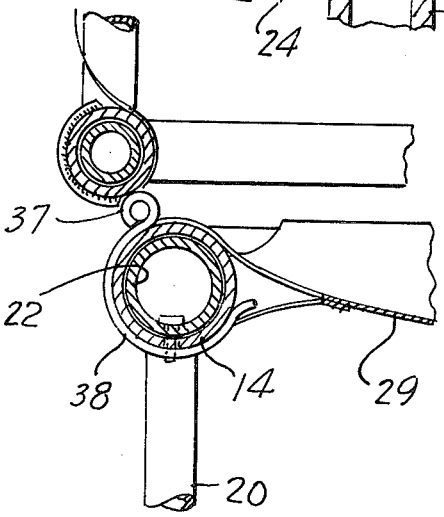
FIG. 10.
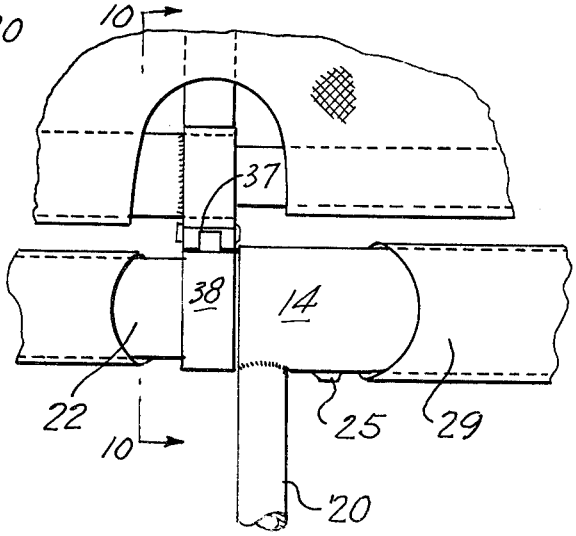
FIG. 9.

PORTABLE DUCK BLIND CAMP COT AND BACK PACK

BACKGROUND OF THE INVENTION

FIELD OF THE INVENTION

The present invention relates to field apparatus which forms a portable duck blind, a camp cot and a back pack.

SUMMARY OF THE INVENTION

The instant invention included a plurality of frame sections which are telescoped together each having legs to support the frame section from the ground. When fully extended the frame sections support a canvas to serve as a bed or a support for the hunter using the device as a duck blind. In collapsed position the frame can be supported from the shoulders of a back pack by the use of a pair of shoulder straps. A telescoping camouflage cover is provided for the device for use as a duck blind and can be quickly and easily swung out of position when the hunter desires to raise to shooting position.

The primary object of the invention is to provide a combined duck blind camp cot and back pack which is inexpensive to manufacture, simple to use and effective in its use.

Other objects and advantages will become apparent in the following specification when considered in light of the attached drawings.

BRIEF DESCRIPTION OF THE DRAWINGS

FIG. 1 is a top plan view of the invention;

FIG. 2 is a side elevation of the invention;

FIG. 3 is an end elevation of the invention;

FIG. 4 is a side elevation of the device collapsing to a back pack relation;

FIG. 5 is an enlarged fragmentary vertical sectional view, taken on the line 5—5 of FIG. 3, looking in the direction of the arrows with the sections partially telescoped together;

FIG. 6 is an enlarged fragmentary view similar to FIG. 5;

FIG. 7 is a transverse cross-section taken on the line 7—7 of FIG. 6, looking in the direction of the arrows;

FIG. 8 is a view similar to FIG. 6 with the latch in latching position;

FIG. 9 is a fragmentary plan view of the connection between the cot and the cover; and FIG. 10 is a fragmentary transverse sectional view, taken on the line 10—10 of FIG. 9, looking in the direction of the arrows.

DESCRIPTION OF THE PREFERRED EMBODIMENT

Referring now to the drawings in detail, wherein like reference characters indicate like parts throughout the several figures, the reference numeral 10 indicates generally, a portable duck blind camp cot and back pack device constructed in accordance with the invention.

The device 10 includes a cot portion indicated generally at 11 and a cover portion indicated generally at 12. The cot portion 11 has a pair of tubular side members 13, 14 connected by a pair of spaced parallel generally horizontal tubular members 15, 16. A U-shaped leg 17 is connected to the frame members 13, 14 and depends perpendicularly therefrom. An inverted concaved foot member 18 is secured to the leg member 17 across the lower portion thereof to prevent the leg 17 from penetrating the ground. A pair of spaced parallel tubular rods 19 extend across the U-shaped leg 17 parallel to the tubular member 15. The rods 19 form a bottom support for the device when used as a back pack.

A second generally U-shaped leg 20 is secured to the frame members 13, 14 in spaced parallel relation to the leg 17 as can be clearly seen in FIG. 2. An inverted concaved foot 21 is secured to the lower portion of the leg 20 in horizontal alignment with the foot 18.

A pair of spaced parallel tubular frame members 22, 23 are telescopically mounted in the frame members 13, 14 respectively and are connected together at their outer ends by a U-shaped leg member 20 having an inverted concaved foot member 21 on its lower end.

The frame members 13, 14 each have a latch slot 24 formed on the lower portion thereof adjacent the U-shaped leg 20. A spring latch 25 is secured within the frame member 22 by a rivet 26 and projects through a slot 27 in the frame member 22 in order to engage in the slot 24 of the frame member 13 as can be seen in FIGS. 6 and 8. A plurality of successively smaller tubular frame members **22*a*, 22*b* and 22*c* are telescopically positioned within each of the next larger frame members and are provided with latches 25 engaging in keeper slots 24 to maintain the cot portion 11 in extended position as it is opened. The smallest frame member 22*c* is not only connected to the frame member 23*c* by means of a leg 20 but has an integral cross member 28 extending therebetween. The frame member 22*b* is connected to the frame member 23*b* by means of a leg 20 and the frame member 22*a* is connected to the frame member 23*a* by a leg member 20 all as can be clearly seen in FIG. 1 and 2. A canvas support platform 29 encompasses the side frames and end frames of the cot portion 11** and is stretched tautly therebetween with the cot in its extended position to serve as a support for the user when in a reclining position.

A pair of shoulder straps 30 are secured respectively to the frame members 13, 14 to engage over the shoulders of the wearer so that with the cot portion 11 in the collapsed position as illustrated in FIG. 4 it can be carried on the back with additional equipment supported on the leg 17 and rods 19 to be carried by a hiker.

The cover portion 12 consists of a pair of spaced parallel tubular frame members 31 integrally connected into a horizontal U-shaped member by a transverse portion 32. A pair of inverted U-shaped cover supports 33 are secured to the frame members 31 in spaced parallel relation. A pair of spaced parallel frame members 34 are telescopically received in the frame members 31 and are connected by an inverted U-shaped cover support 35. A pair of spaced parallel frame members **34*a* are telescopically received in the frame members 34 and are connected by a U-shaped cover support 35*a*. A pair of spaced parallel frame members 34*b* are telescopically received in the frame members 34*a* and are connected by an inverted U-shaped cover support 35*b*. A pair of spaced parallel frame members 34*c* are telescopically received in the frame members 34*b* and are connected by an inverted U-shaped cover support 35*c* and by a transverse cross member 36. A plurality of hinge members 37 are connected to the frame members 31, 34 34*b* and 34*c* with each having a spring snap clamp 38 inwardly formed thereon in depending relation thereto to encompass an adjacent frame member 14, 23, 23***b* and 23*c* in order to secure the cover member 12 to the cot 11 so that the cover member 12 can be quickly thrown off as desired by the user.

A cover 39 is supported on the cover supports 33, 35, 35*a*, 35*b* and 35*c* to form an enclosure within which the user lies while sleeping or waiting for ducks. An inflatable pillow 40 is supported on the frame members 13, 14 and the canvas 29 being secured thereto by straps 41. The pillow 40 has a relatively long inflating tube 42 extending outwardly therefrom to permit the pillow 40 to be inflated by the user after enclosing himself within the cover portion 12 while on the cot 11.

In the use and operation of the invention the cot portion 11 is extended and latched from its back pack condition as illustrated in FIG. 4 to the extended condition as illustrated in FIG. 2. The cover portion 12 is then extended and the spring clamps 38 are snapped onto the frame members 13, 23, 23*b* and 23*c* of the cot portion 11. The hunter when using the device as a duck blind then raises the cover portion 12 and reclines on the cot portion 11 lowering the cover portion 12 so that he is hidden completely from the duck. He then inflates the pillow 40 to whatever pressure is suitable to him and rest quietly while waiting for the ducks. When ducks are heard and he is ready to shot he flips the cover portion 12 open quickly on its hinges 37 and raises to a firing position along side of the cot portion 11.

When using the cot portion 11 for sleeping purposes the cover portion 12 may be discarded or it may serve as a tent to protect the user if this be desired.

Having thus described the preferred embodiment of the invention it should be understood that numerous structural modifications and adaptations may be resorted to without departing from the spirit of the invention.

What is claimed is:

1. A combined duck blind, cot and back pack comprising a plurality of relatively rigid frame sections having telescoping side frame members, a plurality of generally U-shaped legs integrally connecting each of said frame sections and extending generally parallel to each other, a canvas support secured to said frame sections for supporting an occupant, spring urged latch and recess means on said frame sections for locking said frame sections in extended position, a fabric cover member to cover the entire cot detachably secured to said device with said cover member being hinged parallel to the longitudinal axis of the cot at regular spaced intervals along the entire length of the device to permit the cover to be moved into and out of covering position with respect to said device, a plurality of telescopically collapsible related frame sections forming said cover member, and a plurality of clamping members attached to said cover, each clamping member adapted to releasably attach to a plurality of cot frame members.

* * * * *